US009717303B2

(12) United States Patent
Walker et al.

(10) Patent No.: US 9,717,303 B2
(45) Date of Patent: Aug. 1, 2017

(54) FLEXIBLE SOLE FOR FOOTWEAR

(75) Inventors: Mark Walker, Northampton (GB); Joachim Sedelmeier, London (GB)

(73) Assignee: J-Walk Limited, Weston Favell (GB)

( * ) Notice: Subject to any disclaimer, the term of this patent is extended or adjusted under 35 U.S.C. 154(b) by 98 days.

(21) Appl. No.: 13/978,695

(22) PCT Filed: Jan. 17, 2012

(86) PCT No.: PCT/EP2012/050622

§ 371 (c)(1),
(2), (4) Date: Oct. 24, 2013

(87) PCT Pub. No.: WO2012/098105

PCT Pub. Date: Jul. 26, 2012

(65) Prior Publication Data

US 2014/0041261 A1 Feb. 13, 2014

(30) Foreign Application Priority Data

Jan. 18, 2011 (GB) ..... 1100791.1

(51) Int. Cl.
*A43B 1/10* (2006.01)
*A43B 5/00* (2006.01)
(Continued)

(52) U.S. Cl.
CPC ..... *A43B 13/18* (2013.01); *A43B 3/0057* (2013.01); *A43B 13/141* (2013.01); *A43B 13/181* (2013.01); *A43B 13/223* (2013.01)

(58) Field of Classification Search
CPC ..... A43B 13/18; A43B 13/141; A43B 3/0057; A43B 13/122; A43B 13/16; A43B 13/125; A43B 13/181; A43B 13/223; A43B 13/14
(Continued)

(56) References Cited

U.S. PATENT DOCUMENTS 500,385 A * 6/1893 Hall ..... 36/102
4,309,831 A * 1/1982 Pritt ..... 36/3 B
(Continued)

FOREIGN PATENT DOCUMENTS

DE 1485816 A1 * 4/1971 ..... A43B 13/14
DE 29602610 U1 4/1996
(Continued)

OTHER PUBLICATIONS

Hindle, James. UK Intellectual Property Office: Examination Report for Application No. GB1100791.1. Feb. 16, 2016.
(Continued)

*Primary Examiner* — Jameson Collier
(74) *Attorney, Agent, or Firm* — PatentBest; Andrew McAleavey

(57) ABSTRACT

An injection molded sole (10) has an upper ungrooved portion (2) and a lower tread portion (4). At least two, continuous, undulating S-shaped grooves (6) extend generally longitudinally of the tread portion between the toe and heel ends thereof, and a plurality of grooves extending generally transversely intersect the longitudinally extending undulating grooves. The grooves have a minimum depth of about 5 mm and define individual separated tread areas (28) which can be moved apart during flexing of the sole (10). The flexibility of the sole is such that when it is incorporated in footwear, it does not restrict rolling movements of the foot when walking so that a gait can be adopted which is akin to barefoot walking.

17 Claims, 9 Drawing Sheets

(51) Int. Cl.

| | |
|---|---|
| ***A43B 13/00*** | (2006.01) |
| ***A43B 13/14*** | (2006.01) |
| ***A43B 13/18*** | (2006.01) |
| ***A43B 13/22*** | (2006.01) |
| ***A43B 3/00*** | (2006.01) |

(58) Field of Classification Search
USPC ..... 36/102, 103, 25 R, 28, 30 R, 32 R, 59 C
See application file for complete search history.

(56) References Cited

U.S. PATENT DOCUMENTS

| | | | | |
|---|---|---|---|---|
| 4,377,041 | A * | 3/1983 | Alchermes | 36/30 R |
| D421,832 | S * | 3/2000 | Loveder | D2/957 |
| 6,065,230 | A * | 5/2000 | James | 36/25 R |
| D469,949 | S * | 2/2003 | Koo | D2/960 |
| D475,510 | S * | 6/2003 | Reynolds | D2/946 |
| 6,574,889 | B2 * | 6/2003 | Cagner | 36/102 |
| D492,095 | S * | 6/2004 | Sanchez et al. | D2/896 |
| D543,340 | S * | 5/2007 | Favreau | D2/953 |
| 7,392,605 | B2 * | 7/2008 | Hatfield | A43B 3/0057 36/102 |
| 8,272,149 | B2 * | 9/2012 | Cooper et al. | 36/102 |
| 2005/0076536 | A1 | 4/2005 | Hatfield et al. | |
| 2007/0169379 | A1 * | 7/2007 | Hazenberg et al. | 36/102 |
| 2007/0199211 | A1 * | 8/2007 | Campbell | 36/59 R |
| 2007/0199213 | A1 | 8/2007 | Campbell et al. | |
| 2008/0201992 | A1 * | 8/2008 | Avar et al. | 36/25 R |
| 2008/0229617 | A1 * | 9/2008 | Johnson et al. | 36/102 |
| 2009/0013558 | A1 * | 1/2009 | Hazenberg | A43B 1/0009 36/88 |
| 2009/0044432 | A1 | 2/2009 | O'Connor et al. | |
| 2009/0188132 | A1 * | 7/2009 | Fujikawa et al. | 36/103 |
| 2010/0269376 | A1 * | 10/2010 | Flannery et al. | 36/30 R |
| 2010/0299965 | A1 * | 12/2010 | Avar et al. | 36/102 |
| 2011/0126428 | A1 * | 6/2011 | Hazenberg et al. | 36/103 |
| 2011/0214313 | A1 * | 9/2011 | James et al. | 36/103 |
| 2013/0055596 | A1 * | 3/2013 | Wan et al. | 36/25 R |
| 2013/0152428 | A1 * | 6/2013 | Bishop et al. | 36/103 |
| 2013/0174444 | A1 * | 7/2013 | Jacobs et al. | 36/28 |
| 2014/0013624 | A1 * | 1/2014 | Stockbridge et al. | 36/103 |
| 2014/0150297 | A1 * | 6/2014 | Holmes et al. | 36/103 |
| 2014/0259744 | A1 * | 9/2014 | Cooper | 36/28 |

FOREIGN PATENT DOCUMENTS

| | | | | |
|---|---|---|---|---|
| DE | 29919124 | | 3/2000 | |
| EP | 383489 | A1 * | 8/1990 | A43B 13/12 |
| GB | 919658 | A * | 2/1963 | |
| GB | 2431857 | A | 5/2007 | |
| JP | 5710083 | B1 * | 4/2015 | A43B 13/14 |
| WO | 2006124116 | A2 | 11/2006 | |
| WO | 2008115743 | A1 | 9/2008 | |

OTHER PUBLICATIONS

Hindle, James. UK Intellectual Property Office: Examination Report for Application No. GB1100791.1. Nov. 26, 2015.

* cited by examiner

FLEXIBLE SOLE FOR FOOTWEAR

CROSS-REFERENCE TO RELATED APPLICATIONS

This application is the U.S. National Phase of PCT International Application No. PCT/EP2012/050622, filed on Jan. 17, 2012. That application claims priority to United Kingdom Patent Application No. 1100791.1, filed Jan., 18, 2011.

FIELD OF THE INVENTION

The present invention relates to a flexible sole for an article of footwear.

BACKGROUND OF THE INVENTION

It has been suggested that adults benefit from a gait akin to that of barefoot walking when wearing footwear.

SUMMARY OF THE INVENTION

The present invention seeks to enable the provision of footwear allowing a sensation similar to barefoot walking.

According to the present invention, there is provided a flexible sole for an article of footwear, the sole being designed to have flexibility such that it allows a foot to roll during walking;

the sole having been manufactured from ethylene-vinyl acetate (EVA) by injection moulding to have an upper, ungrooved portion, and a lower, tread portion having a plurality of grooves extending therein which open in the bottom surface of the sole;

the sole comprising:

at least two, continuous, undulating grooves extending generally longitudinally of the tread portion between the toe and heel ends thereof, each end of each undulating groove being at a similar acute angle relative to a heel to toe line extending generally longitudinally of the sole; and a plurality of grooves extending generally transversely of the tread portion from a medial edge to a lateral edge thereof, each transverse groove intersecting the longitudinally extending undulating grooves;

wherein the grooves in the sole have a minimum depth of about 5 mm, and the upper, ungrooved portion of the sole has a depth of about 4 to 6 mm.

Footwear incorporating soles of embodiments of the invention is very flexible and provides a sensation akin to barefoot walking.

Preferably, the grooves in the tread portion have a minimum depth of 5 mm.

For example, the grooves in the tread portion have a depth between 5 mm and 15 mm.

In an embodiment, the upper ungrooved portion of the sole has a depth of about 5 mm.

In one embodiment, the grooves within the tread portion have an elongate, tapered cross-section extending from a wide mouth opening in the bottom surface of the sole to a narrower closed end.

The continuous undulating grooves extending between toe and heel ends of the sole are generally S-shaped. Preferably, each end of each S-shaped groove extends at an angle of between 20 and 30 degrees to the generally longitudinal heel to toe line.

Preferably, each transverse groove intercepts an S-shaped groove at an angle generally between 80 and 100 degrees.

In an embodiment, the transverse grooves at the heel and toe ends of the sole intersect the S-shaped grooves at an angle of between 85 degrees and 95 degrees.

There are generally more transverse grooves in a toe portion of the sole as compared to a heel portion thereof. Furthermore, there are generally more longitudinally extending grooves in the toe portion of the sole as compared to the heel portion of the sole. In addition, the grooves in the toe portion of the sole are generally closer together than those in the heel portion thereof.

BRIEF DESCRIPTION OF THE DRAWING FIGURES

Embodiments of the present invention will hereinafter be described, by way of example, with reference to the accompanying drawings, in which:

FIGS. 1*a*, 1*b* and 1*c* show respectively a top view, a bottom view and a side view of a sole for a shoe of the present invention;

DETAILED DESCRIPTION

Dr. Stefan Grau of the University of Tuebingen is an expert in footwear biomechanics and has proposed the provision of specialised treads for shoe soles. For example, in DE29919124 Dr. Grau shows a tread for safety footwear.

Dr. Grau has suggested that a healthy adult will benefit from adopting a gait, when wearing shoes, which apes the gait of barefoot walking. He has explained that, to do this, the sole of the shoe needs to have sufficient flexibility to allow the foot to roll during walking.

The present invention provides a sole for a shoe or other article of footwear which is designed, using the theories of Dr. Grau, to allow the foot to roll during walking.

Figures 1A, 1B, 1C:
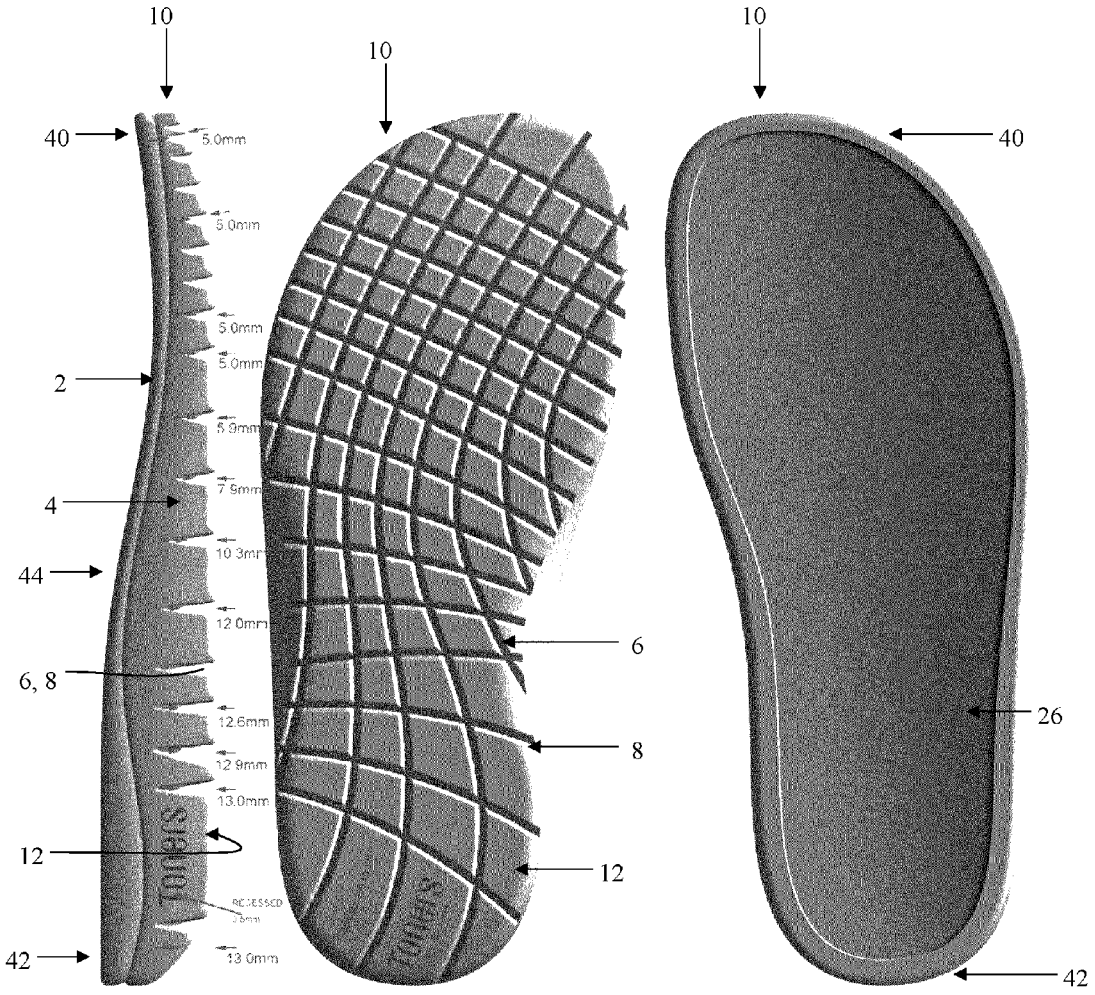

FIGS. 1*a*, 1*b* and 1*c* show respectively a top view, a view from below, and a side view of a sole of an embodiment of the present invention. This sole may be provided with appropriate straps or foot engagement means on its upper surface, for example, to constitute a shoe, sandal, or other article of footwear or, in any appropriate manner, may be fixed to an upper to form a shoe or other article of footwear.

The sole is manufactured from EVA (ethylene-vinyl acetate) and is made by injection moulding so that it is formed in a mould in one piece. It has been found that using an injectable EVA maximises the flexibility of the soles produced, and also allows the design to incorporate deep grooves without danger of cracking during prolonged and repeated flexing. The resultant material of the sole not only has excellent resilience but is also light in weight. This is important as it relieves pressure on the foot during both standing and walking.

As is apparent from FIGS. 1*b* and 1*c*, a sole 10 is manufactured to have an upper, ungrooved portion 2 and a lower tread portion 4. As can be seen, the tread portion 4 has a plurality of grooves 6, 8 extending therein. As is clearly shown in the side view of FIG. 1*c*, the grooves, 6, 8 open in the bottom surface 12 of the sole 10.

Figure 2:
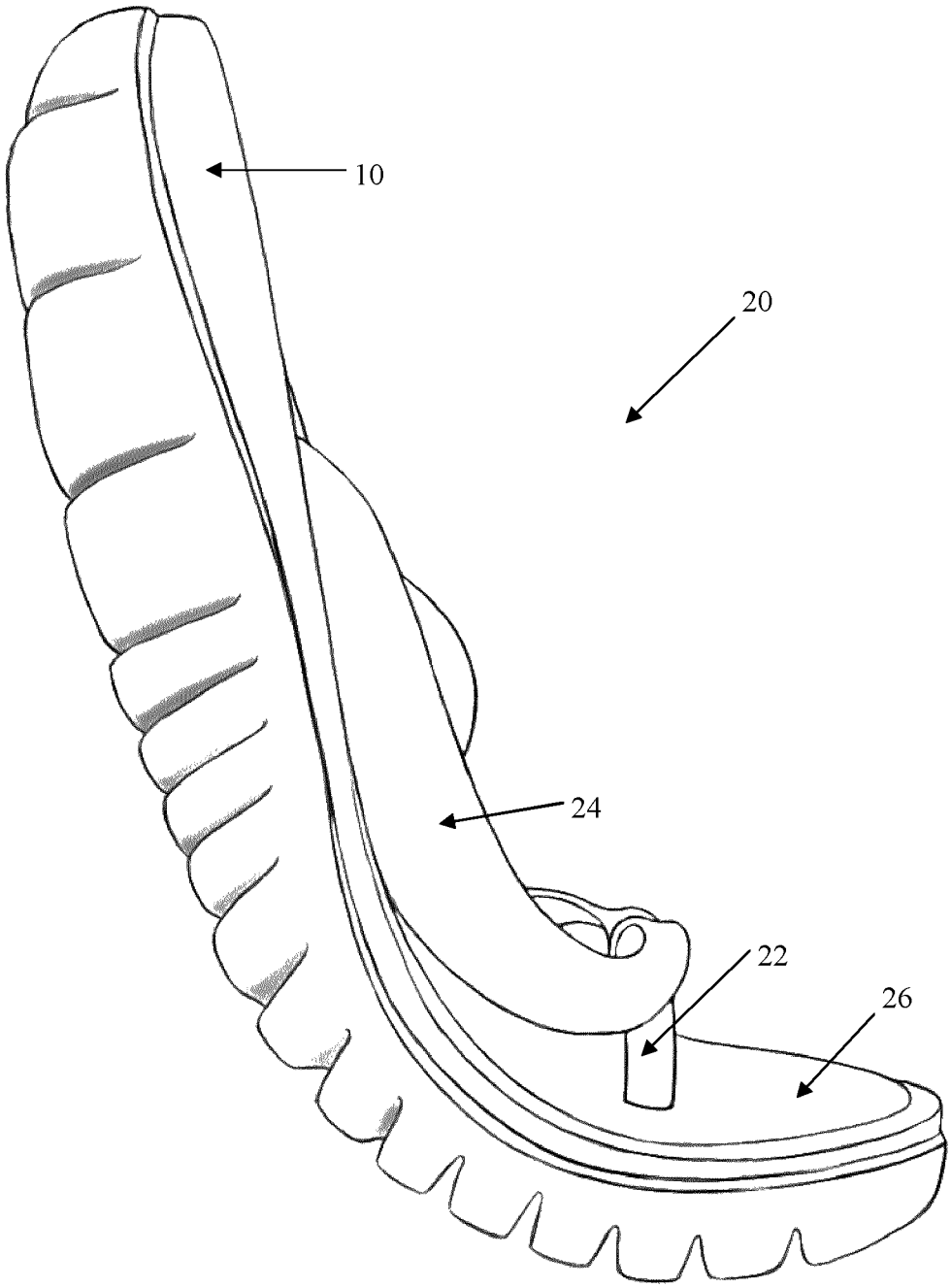
FIG. 2 shows a perspective view of a sandal incorporating a sole as in FIG. 1.

As will be explained further below, the grooves 6, 8 are located, sized and shaped to give the sole 10 the required flexibility. The great flexibility of the sole in many directions is apparent from FIGS. 2 to 4, for example. In this respect FIG. 2 shows the sole 10 incorporated within a sandal of flip flop style 20. To form the sandal 20 an appropriate post 22 with straps 24 is affixed to an upper surface 26 of the sole 10. FIG. 2 illustrates the extreme longitudinal flexibility the construction of the sole 10 gives to the sandal 20.

Figure 3:
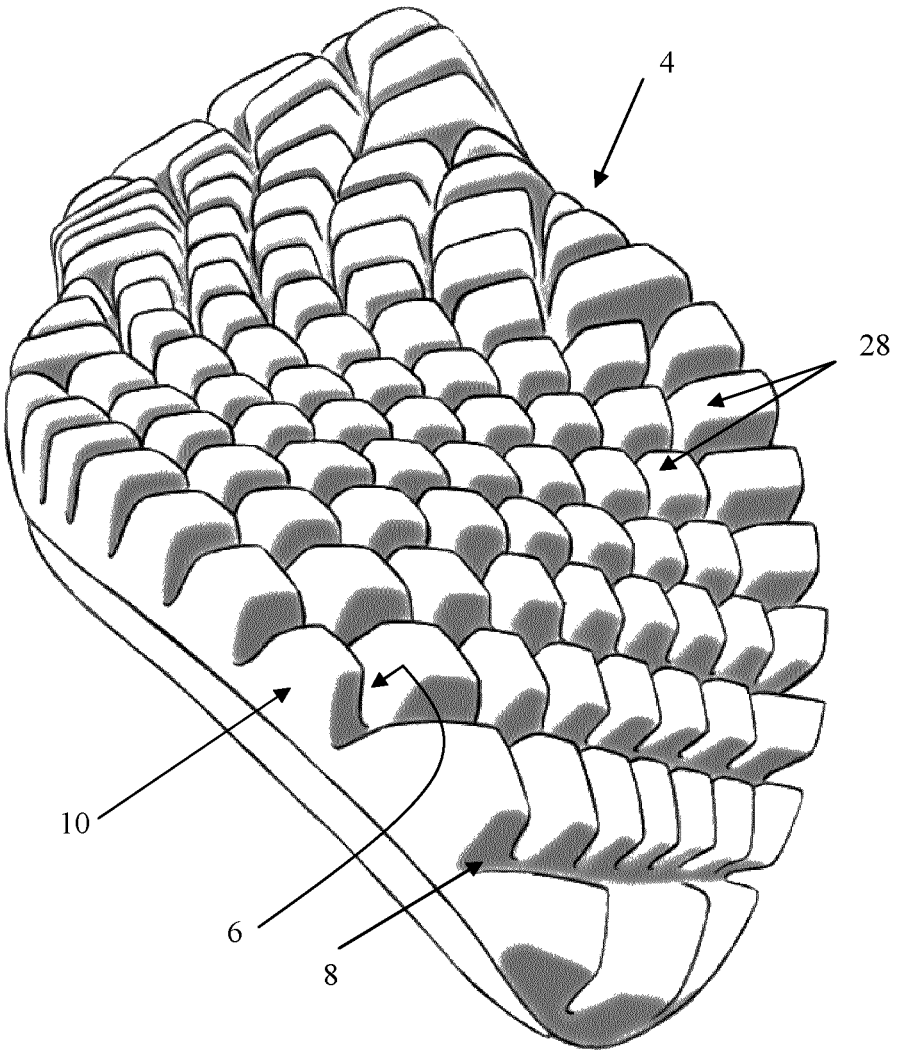
FIG. 3 shows a perspective view from below of a sole of FIG. 1 when flexed.

FIG. 3 is a view from below of the lower tread portion 4 of a sole 10 showing flexing of the sole 10 as allowed by the grooves 6 and 8. It will be appreciated that as the sole 10 is flexed, individual tread areas 28 defined by the grooves become separated.

Figure 4:
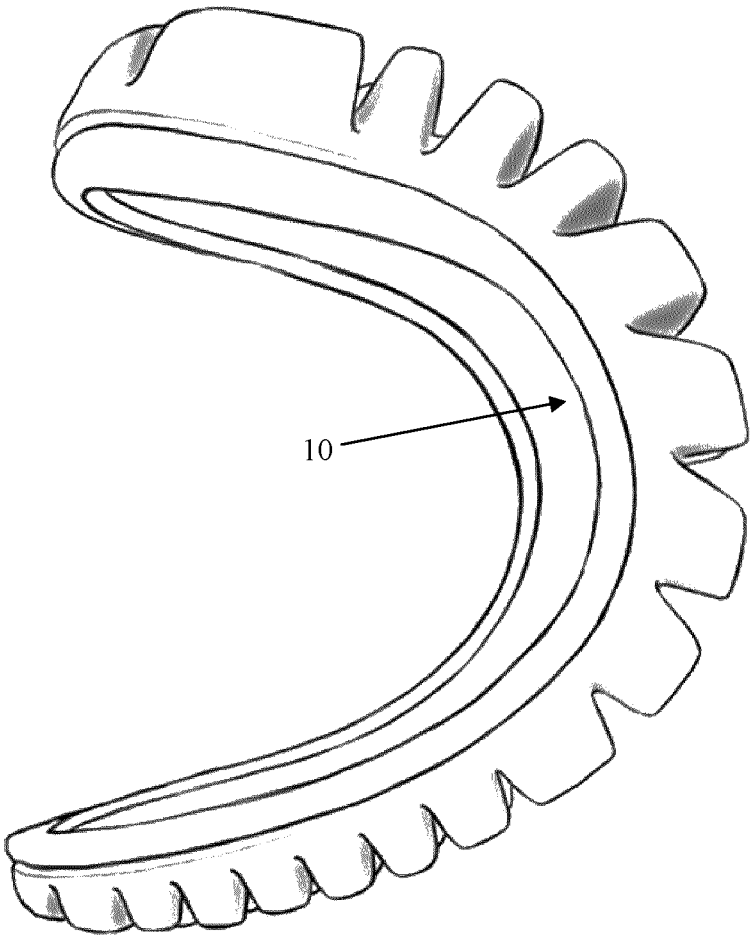
FIG. 4 shows a side view of a sole as in FIG. 1 when flexed.

FIG. 4 shows a side view of a sole 10 showing how it can be folded over because of its flexibility. FIG. 4 is provided to illustrate the extreme flexibility which the construction of the sole provides.

Figure 5:
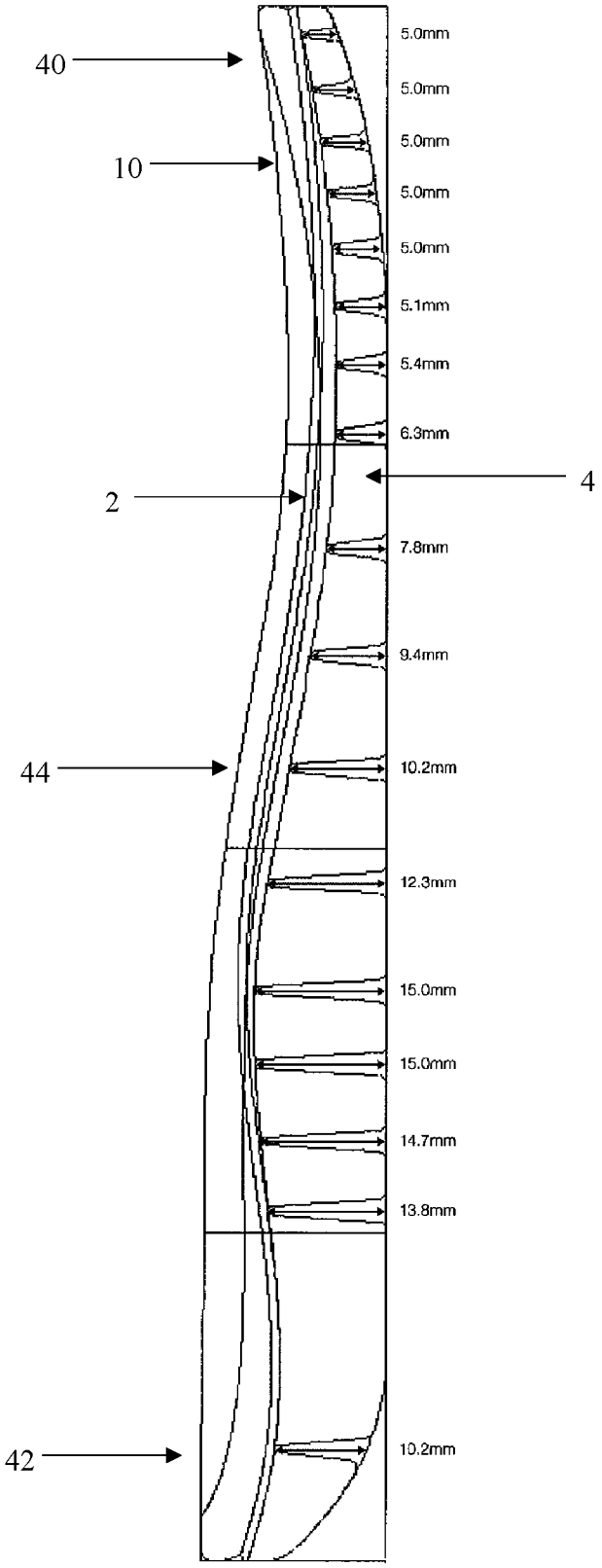
FIG. 5 shows a side view of a sole of the invention indicating exemplary groove sizes.

As set out above, the sole 10 has an upper ungrooved portion 2 and a lower tread portion 4 in which a plurality of grooves are formed. FIG. 1*c* shows that the grooves have a depth ranging from 5 mm to 13 mm. FIG. 5 shows an alternative version of a sole 10 in which the grooves 6, 8 have a depth between 5 mm and 15 mm. In this respect, to give the sole the flexibility required, the grooves 6, 8 should have a minimum depth of 5 mm.

Figure 6:
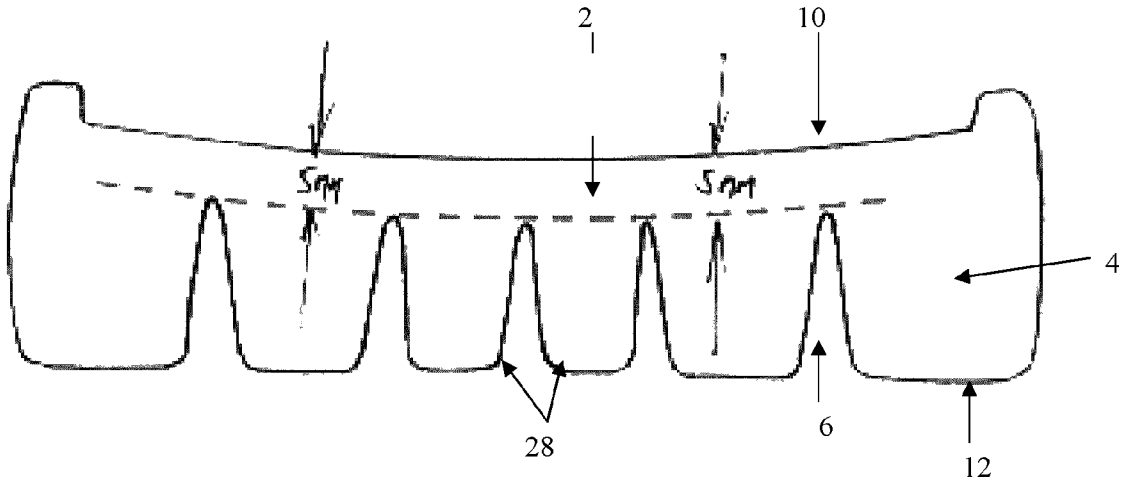
FIG. 6 shows a cross-section of the sole of FIG. 1 indicating the thickness of an upper ungrooved portion and illustrating the shape of the grooves.

The grooves need to be as deep as possible within the confinement of the sole. Furthermore, for the comfort of the wearer of the footwear incorporating the sole, there has to be a minimum amount of material between the foot and the grooves. As illustrated in FIG. 6, generally, this upper ungrooved portion 2 of the sole 10 will have a minimum depth of 4 to 5 mm. However, for maximum flexibility of the sole 10, this ungrooved portion 2 needs to be as thin as is practically possible. In practice, the maximum depth of this ungrooved portion 2 of the sole will be of the order of 5 mm to 6 mm. In most embodiments, the depth of the ungrooved portion 2 will be chosen to be of the order of 5 mm.

For comfort, the depth of the grooves 6, 8, and hence the overall depth of the tread portion 4, will generally be smaller at a toe end 40 of the sole 10 than at a heel end 42 thereof. In the embodiment of FIG. 1*c*, the depth of the grooves is at the minimum 5 mm at the toe end 40 of the sole, increases in a waist portion 44 thereof, and is at the maximum at the heel end 42. In the arrangement shown in FIG. 5, there is a general increase in the depth of the grooves from the toe end 40, where the grooves are at a minimum 5 mm, through a waist portion 44 at which the grooves have extended to 10.2 mm, and at the heel end 42 where the grooves are also at 10.2 mm. However, it will be seen that the deepest grooves, of 15 mm, are to the heel side of the waist portion 44. This construction differs from conventional soling and makes the sole 10 very unstructured which adds to its flexibility.

FIG. 6 shows a cross-section through a sole 10 in which the ungrooved upper portion 2 has a depth of 5 mm. It will be seen that the grooves 6 shown therein are of a tapered shape having a wide mouth opening into the base surface 12 of the sole 10, and then tapering as they extend into the tread portion 4. The grooves 8 also have such an elongate, tapered shape.

It is this tapered shape of the grooves 6, 8 which ensures that there is clear definition, and separation, of the individual tread areas 28. This creation of individual and separated tread areas 28 provides for maximum flexibility for the sole 10 as it provides less restriction of flexing movements in any direction.

Figure 7:
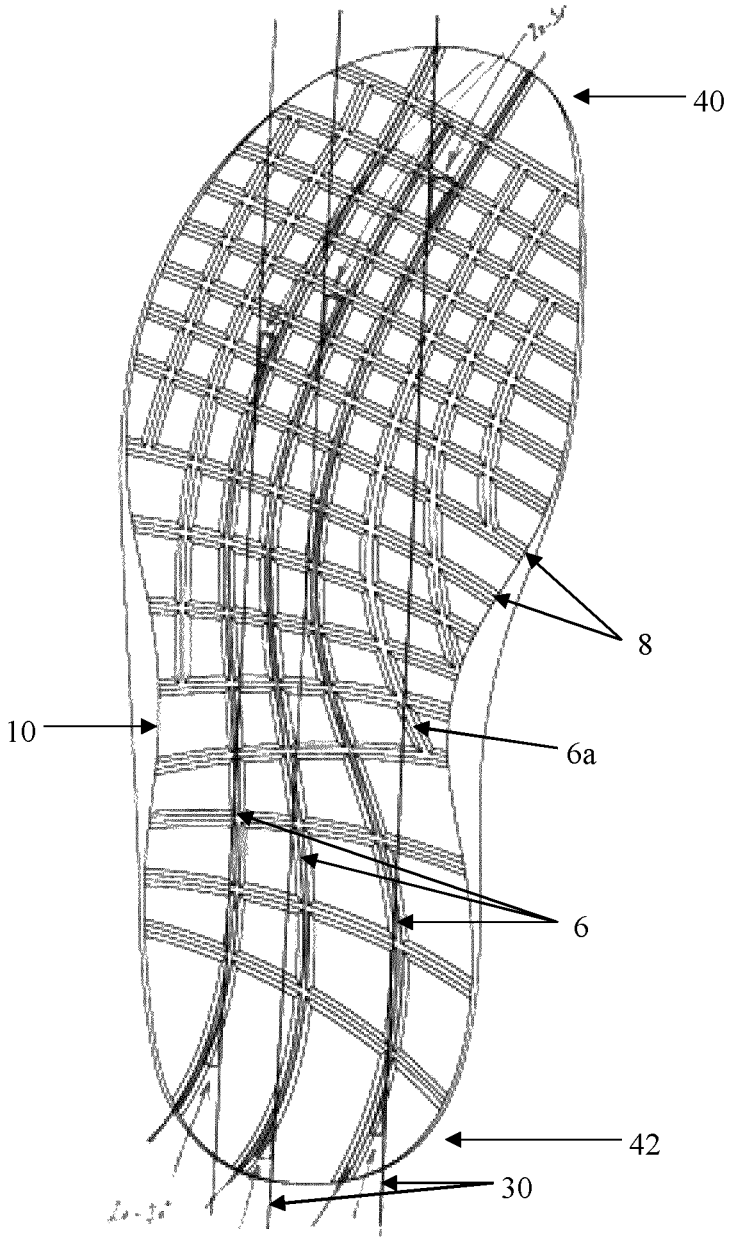
FIG. 7 shows a view from below of the base of a sole of the invention illustrating the position, and pattern, of the grooves.
Figure 8:
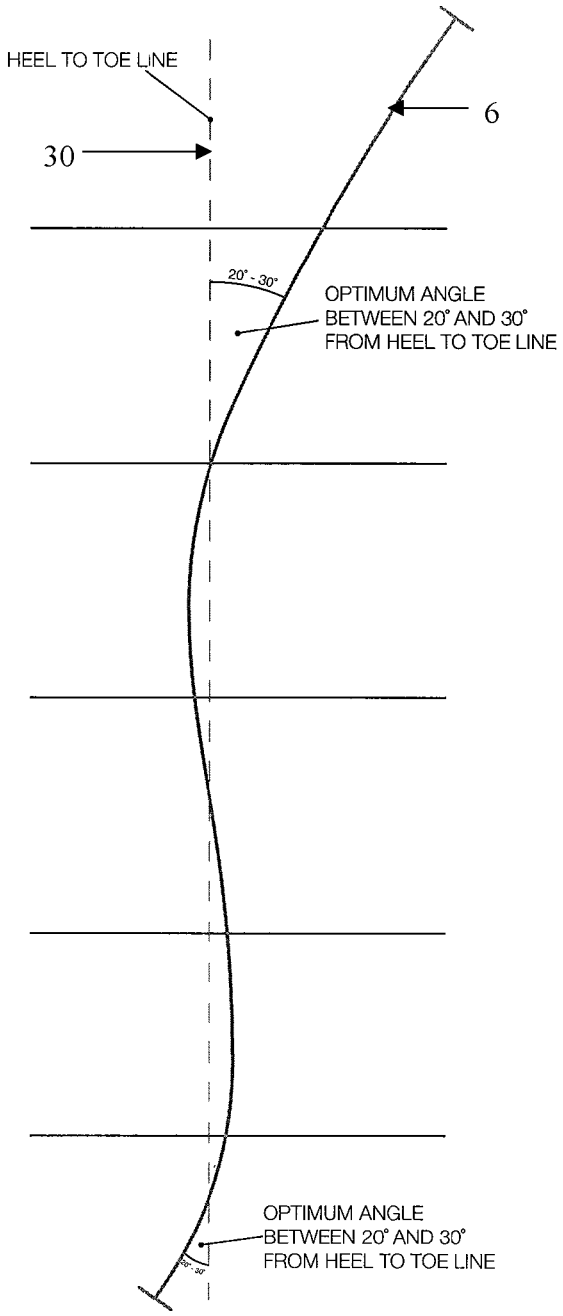
FIG. 8 shows the relationship between one longitudinal undulating groove of the sole relative to a heel to toe line through the sole.

As described above, the sole 10 has been designed and constructed to provide maximum flexibility. However, it is important to ensure that that flexibility is such that the sole can follow the natural roll of the foot during walking. This requires that the flexibility is controlled and the control is provided by the selection of grooves 6, 8 within the sole 10 and their relative location. FIG. 7 shows a bottom view of the sole 10 clearly illustrating the arrangement or pattern of the grooves 6, 8. The sole 10 has a general longitudinal extent between the toe and heel ends 40, 42 as indicated by the superimposed generally longitudinal heel to toe lines 30. It will be seen that there are three continuous, undulating grooves 6 in the sole 10 which extend generally longitudinally of the tread portion 4 between the toe and heel ends 40, 42. One of the undulating grooves extends from the heel end and terminates at a location spaced away from the toe end. There are also a number of other continuous grooves 6*a* which are generally of a similar shape to the grooves 6, but which do not extend the full length of the sole 10. Each of the continuous, undulating grooves 6 extends at the toe end 40 at an acute angle to the generally longitudinal heel to toe line 30. Similarly, at the heel end 42 each groove 6 also extends at an acute angle thereto to the heel to toe line 30. As is clearest in FIG. 8, the acute angle in each case is generally between 20 and 30 degrees. It will be seen that each continuous groove 6, which extends the full length of the sole 10, is generally 'S-shaped'. As shown in FIG. 1*b*, the two continuous grooves 6 are generally in phase with one another.

The provision of the continuous, undulating grooves 6 extending the full length of the sole 10 is a key to enabling the sole to flex such that it does not restrict natural movement of the foot during walking. There should be at least two such continuous full length grooves 6 provided in a sole 10. Preferably, more than two such grooves 6 are provided, and further continuous grooves 6*a* are provided even though they cannot extend for the full length of the sole.

As well as the plurality of continuous longitudinally extending grooves 6 and 6*a*, a plurality of transversely extending grooves 8 are also formed in the sole 10. It should be noted all the grooves 6, 8, be they longitudinal or transverse, have the same elongate tapering cross-sectional shape. Furthermore, all the grooves 6, 8 at a particular part of the sole will have the same, or similar, depth.

Figure 9:
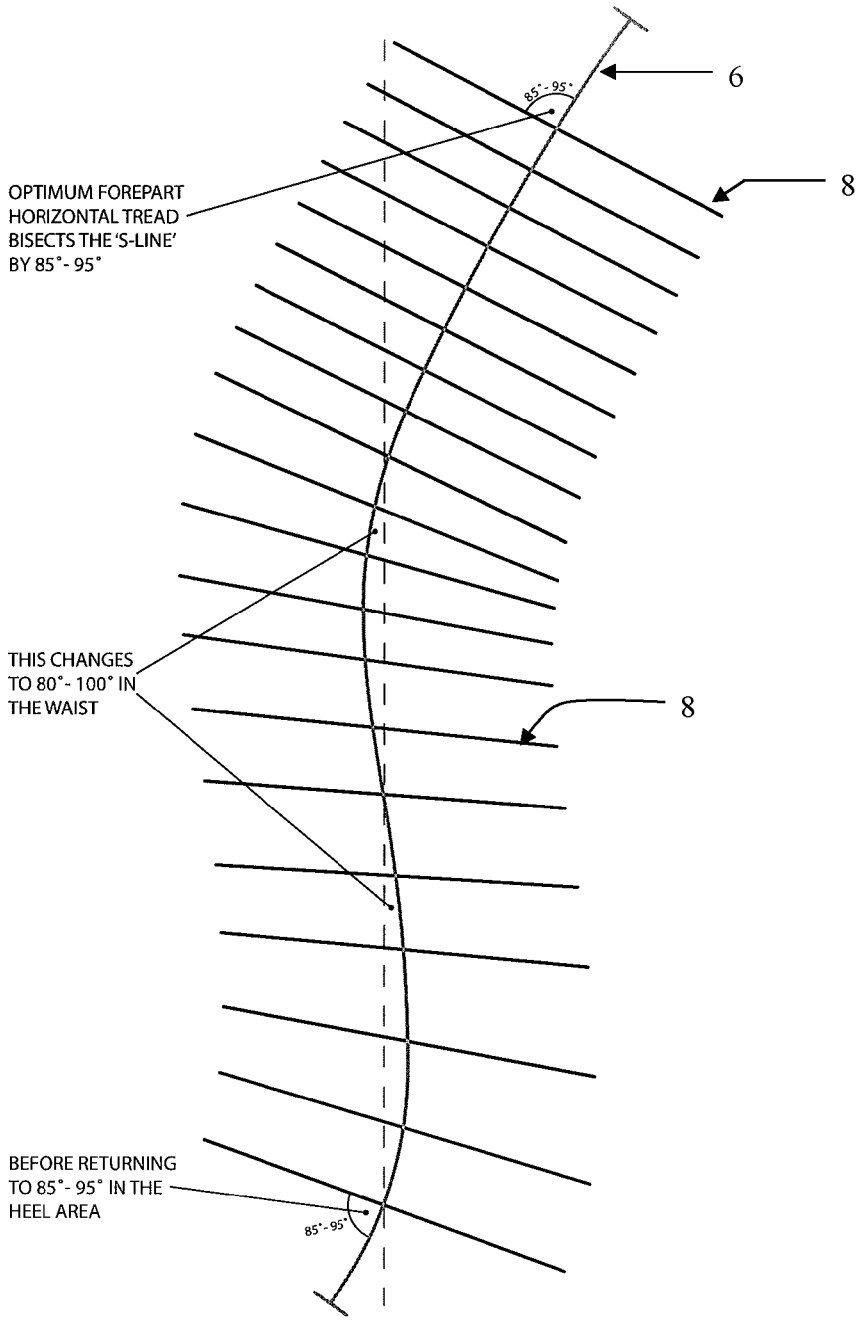
FIG. 9 shows the relative positioning of the undulating groove of FIG. 8 relative to transversely extending grooves.

The transversely extending grooves 8, as indicated in FIG. 9, generally make an angle of about 85 to 95 degrees with the longitudinal grooves 6 and 6*a*. It is preferred to have a large number of these grooves 8, as they do provide maximum flexibility to the sole 10 and therefore allow the foot to roll extremely easily. However, and is apparent from the illustrations, there are generally more transverse grooves in the toe end 40 of the sole as compared to the heel end 42. Similarly, there are generally more longitudinally extending grooves 6*a*, 6 in the toe end as compared to the heel end. The grooves, be they transverse grooves 8 or longitudinally extending grooves 6, are also closer together in the toe end 40 as compared to the heel end 42 of the sole.

The sole 10, as described and illustrated, can be used in footwear to allow the foot to move freely. At the strike of the heel, the sole offers no resistance to the foot which is allowed to twist and roll. As the weight of the person shifts from the back of the foot to the mid and fore part, the foot has unrestricted movement so that the foot and leg muscles have to work to control the walking movement as in barefoot walking.

It will be appreciated that variations in, and modifications of, the embodiments as described and illustrated may be made within the scope of the accompanying claims.

The invention claimed is:

1. A flexible sole for an article of footwear, comprising:
an upper, ungrooved portion having a depth of 4 to 6 mm;
a lower, tread portion contiguous with and depending from the upper, ungrooved portion of the sole; and
grooves formed in the lower, tread portion of the sole, including
a plurality of continuous, undulating grooves extending longitudinally along the sole, at least two of the undulating grooves extending to and between a toe end and a heel end of the sole, one of the plurality of undulating grooves extending from the heel end and terminating at a location spaced away from the toe end, such that the at least two undulating grooves are all spaced apart from one another along entire respective lengths of the at least two undulating grooves, as well generally in-phase with one another, the ends of each of the at least two undulating grooves making similar acute angles with respect to a straight longitudinal line between the heel end and the toe end of the sole; and
a plurality of continuous transverse grooves extending transversely from a medial edge to a lateral edge of the sole, each of the transverse grooves intersecting at least the undulating grooves that extend to and between the toe end and the heel end, the undulating grooves and the transverse grooves all having a minimum depth of 5 mm;
wherein the sole is formed of ethylene-vinyl acetate (EVA) by injection molding.

2. The sole of claim 1, wherein the upper, ungrooved portion of the sole has a depth of about 5 mm.

3. The sole of claim 1, wherein the grooves in the tread portion have a depth between 5 mm and 15 mm.

4. The sole of claim 1, wherein the grooves in the tread portion extend a full thickness of the tread portion.

5. The sole of claim 1, wherein the grooves within the tread portion have an elongate tapered cross-section extending from a wide mouth opening in the bottom surface of the sole to a narrower closed end.

6. The sole of claim 1, wherein there are more transverse grooves in a toe portion of the sole as compared to a heel portion of the sole.

7. The sole of claim 1, wherein there are more undulating grooves in a toe portion of the sole as compared to a heel portion of the sole.

8. The sole of claim 1, wherein the transverse grooves and the undulating grooves at a toe portion of the sole spaced at a closer distance than the transverse and undulating grooves at a heel portion of the sole.

9. The sole of claim 1, wherein the undulations of the at least two undulating grooves are in phase with one another.

10. The sole of claim 1, wherein the transverse grooves vary in depth depending on the transverse grooves' longitudinal position along the sole.

11. The sole of claim 1, wherein the continuous, undulating grooves extending between the toe end and the heel end of the sole are generally S-shaped.

12. The sole of claim 11, wherein each end of each generally S-shaped groove extends at an angle of between 20 and 30 degrees to the straight longitudinal line between the heel end and the toe end of the sole.

13. The sole of claim 11, wherein each transverse groove intercepts the generally S-shaped groove at an angle between 80 and 100 degrees.

14. The sole of claim 13, wherein, in a heel portion and a toe portion of the sole, the transverse grooves intersect each generally S-shaped grooves at an angle of between 85 degrees and 95 degrees.

15. The sole of claim 14, wherein the deepest of the transverse grooves are on a heel side of a waist portion of the sole.

16. A flexible sole for an article of footwear, comprising:
an upper, ungrooved portion having a depth of 4 to 6 mm;
a lower, tread portion contiguous with and depending from the upper, ungrooved portion of the sole; and
grooves formed in the lower, tread portion of the sole, including
a plurality of continuous, undulating grooves extending longitudinally along the sole, at least two of the undulating grooves extending to and between a toe end and a heel end of the sole, one of the plurality of undulating grooves extending from the heel end and terminating at a location spaced away from the toe end, such that the at least two undulating grooves are all spaced apart from one another along entire respective lengths of the at least two undulating grooves across a width of the sole, as well as generally in-phase with one another, the ends of each of the undulating grooves making similar acute angles with respect to a straight longitudinal line between the heel end and the toe end of the sole, and
a plurality of continuous transverse grooves extending transversely from a medial edge to a lateral edge of the sole, each of the transverse grooves intersecting at least the undulating grooves that extend to and between the toe end and the heel end.

17. A flexible sole for an article of footwear, comprising:
an upper, ungrooved portion having a depth of 4 to 6 mm;
a lower, tread portion contiguous with and depending from the upper, ungrooved portion of the sole; and
grooves extending through an entire thickness of the lower, tread portion of the sole, including
a plurality of continuous, undulating grooves extending longitudinally along the sole, at least two of the undulating grooves extending to and between a toe end and a heel end of the sole, one of the plurality of undulating grooves extending from the heel end and terminating at a location spaced away from the toe end, such that the at least two undulating grooves are all spaced apart from one another along entire respective lengths of the at least two undulating grooves, as well as in-phase with one another, the ends of each of the at least two undulating grooves making an acute angle in the range of 20–30° with respect to a straight longitudinal line between the heel end and the toe end of the sole, and
a plurality of continuous transverse grooves spaced from one another along entire lengths of the transverse grooves and extending transversely from a medial edge to a lateral edge of the sole, each of the transverse grooves intersecting at least the undulating grooves that extend to and between the toe end and the heel end;

wherein the flexible sole is configured to allow a foot to roll during walking.

* * * * *